US007686924B2

(12) United States Patent
Gustavsson

(10) Patent No.: US 7,686,924 B2
(45) Date of Patent: Mar. 30, 2010

(54) SUPPORT BODY, HOLDING DEVICE THEREFOR, APPARATUS WITH SUCH BODY FOR TREATMENT OF A WEB, METHODS OF FORMING AN EXTENDED NIP IN THE APPARATUS AND CONTROLLING LOAD IN THE NIP

(75) Inventor: Tord Gustav Gustavsson, Forshaga (SE)

(73) Assignee: Metso Paper Karlstad AB, Karlstad (SE)

( * ) Notice: Subject to any disclaimer, the term of this patent is extended or adjusted under 35 U.S.C. 154(b) by 745 days.

(21) Appl. No.: 10/575,982

(22) PCT Filed: Oct. 15, 2004

(86) PCT No.: PCT/SE2004/001486

§ 371 (c)(1),
(2), (4) Date: Dec. 26, 2006

(87) PCT Pub. No.: WO2005/038130

PCT Pub. Date: Apr. 28, 2005

(65) Prior Publication Data

US 2007/0215302 A1 Sep. 20, 2007

(30) Foreign Application Priority Data

Oct. 21, 2003 (SE) ..... 0302767

(51) Int. Cl.
*D21F 3/00* (2006.01)

(52) U.S. Cl. ..... 162/358.3; 162/272; 162/361; 162/202; 100/153; 100/156

(58) Field of Classification Search ..... 162/358.3, 162/272, 361, 202; 100/153, 156

See application file for complete search history.

(56) References Cited

U.S. PATENT DOCUMENTS 3,839,147 A 10/1974 Daane

FOREIGN PATENT DOCUMENTS

DE 30 30 233 2/1982

OTHER PUBLICATIONS

International Search Report for PCT/SE2004/001486; Filed Oct. 15, 2004; Date of Completion Jan. 20, 2005; Date of Mailing Feb. 9, 2005.

*Primary Examiner*—Mark Halpern
(74) *Attorney, Agent, or Firm*—Alston & Bird LLP

(57) ABSTRACT

A support body (7) for an apparatus having an extended nip (N) that is defined by a contact surface (13) of the support body and an opposed surface (4), the support body having two side surfaces (69, 70) facing from each other and connecting to the contact surface, and a bottom surface (71) facing from the contact surface, the support body being arranged to be moved towards the opposite surface by means of a loading system in order to load the nip via the contact surface. According to the invention the support body is elastically deformable and has its contact surface adaptable to the opposite surface in interaction therewith. The invention also relates to a holding device for such a support body and an apparatus, e.g. a press, for the treatment of a fibre web, said apparatus having such a support body. Furthermore, the invention relates to a method of forming the extended nip in said apparatus by loading the support body by means of the loading system, as well as a method of controlling the load in the extended nip by designing the support body with at least two layers with different elasticity providing a corresponding load profile.

22 Claims, 7 Drawing Sheets

U.S. PATENT DOCUMENTS

| | | | |
|---|---|---|---|
| 4,468,287 | A | 8/1984 | Dahl |
| 4,568,423 | A | 2/1986 | Laapotti |
| 4,576,682 | A | 3/1986 | Laapotti |
| 4,851,119 | A | 7/1989 | Berglöff et al. |
| 5,951,824 | A | 9/1999 | Deshpande |
| 5,980,693 | A | 11/1999 | Liang et al. |
| 6,334,933 | B1 | 1/2002 | Koski |
| 6,387,216 | B1 | 5/2002 | Koski |

FOREIGN PATENT DOCUMENTS

| | | | |
|---|---|---|---|
| DE | 3030233 | * | 2/1982 |
| DE | 44 05 587 | | 9/1994 |
| EP | 0 575 353 | | 12/1993 |
| EP | 1 319 744 | | 6/2003 |
| WO | WO 02/44467 | | 6/2002 |

* cited by examiner

SUPPORT BODY, HOLDING DEVICE THEREFOR, APPARATUS WITH SUCH BODY FOR TREATMENT OF A WEB, METHODS OF FORMING AN EXTENDED NIP IN THE APPARATUS AND CONTROLLING LOAD IN THE NIP

This application is a 371 of PCT/SE04/01486 filed 15 Oct. 2004.

The present invention relates to a support body for an apparatus having an extended nip being defined by a contact surface of the support body and an opposed surface, said support body has two side surfaces facing from each other and connecting to said contact surface, and a bottom surface facing from the contact surface, and is arranged to be moved in the direction towards the opposite surface by means of a loading system in order to load the nip via said contact surface.

The invention also relates to a holding device for such a support body.

The invention also relates to an apparatus/press for the treatment of a fibre web that is manufactured in a paper or board machine, comprising a first structural element and a second structural element which is movably arranged and having an opposite surface for interaction with the first structural element while forming an extended nip, said first structural element comprising a movable clothing and a support body/press body having a contact surface/press surface which defines said nip together with the opposite surface, said support body/press body has two side surfaces facing from each other and connecting to said contact surface/press surface, and a bottom surface facing from the contact surface/press surface, and is arranged to be moved in the direction towards the opposite surface by means of a loading system in order to load the nip via said contact surface/press surface.

The invention also relates to a method of forming an extended nip in an apparatus that comprises said support body.

The invention also relates to a method of controlling the load in an extended nip in an apparatus that comprises said support body.

The previously known presses with an extended press nip has a so-called press shoe, which consists of a metallic material, such as aluminium or steel, and are designed with a press surface, usually a concave press surface, whose profile is very accurately adapted to the opposed counter-pressure surface. Such a press shoe is very complicated to manufacture and therefore involves a very high cost. Due to the fact that it consists of metal, it is relatively rigid and inflexible. The press roll acting as a counter roll of such a shoe press can have a relatively thick cylinder wall which withstands the forces from the press shoe. In accordance with another embodiment of the counter roll, it has a relatively thin cylinder wall and is provided internally with a counter-pressure system for adjustable crowning of the thin and, thus, deformable cylinder wall or shell in dependence of the forces the press shoe has to apply on the counter roll in order to obtain the desired load. Also the press shoe can be crowned in accordance with the crowning of the counter roll, and it will then be usable only in combination with this counter roll. Alternatively, the metallic press shoe can be tilted by means of hydraulic cylinders.

A Yankee cylinder has a cylinder wall or shell which is relatively thin, and which easily is deformed by impression of the press shoe when the Yankee cylinder is used as a counter roll. The deformation of the shell varies in an axial direction from the central region in a direction towards the end walls, where the impression is substantially smaller than within the central region. Therefore, the press shoe will act with a higher pressure at and in the vicinity of the end walls, resulting in an increased wear at the edges of the press felt and an irregular load profile along the press shoe, which in its turn results in variable paper properties crosswise to the machine direction. It has been proposed to crown the shell of the Yankee cylinder by means of an internal counter-pressure system, or to arrange two or more rows of hydraulic cylinders on the underside of the press shoe for influencing the press shoe to conform to the deformed surface, in both cases in order to achieve a more uniform load profile. Both proposals, however, are complicated and expensive to carry out.

The following documents are examples of presses having extended press nips.

DE 44 05 587 and WO 02/44467 describe a press having a hydrostatic bearing, including a press shoe 3 or double press shoes 3*a*, 3*b* of the same design. A press belt 6 rotates on top of a lubricating fluid bed of the press shoe 3 with a very small friction. The press shoe, which is made of metal, has a pressure chamber 10 containing a hydraulic fluid, preferably water. A rectangular pressure-equalizing membrane 20, consisting of a suitable solid material, preferably stainless steel, is fixed on the press nip side of the press shoe. The pressure-equalizing membrane 20 has an outer edge 26, an inner edge 22, and an opening 27 that is defined by the inner edge 22. The pressure-equalizing membrane 20, thus looking like a frame, is flexible so that an edge zone 21, standing in direct contact with the hydraulic fluid, can deflect when pressure differences occur between its two sides. These pressure differences arise when hydraulic fluid happens to leak out through the press nip as a result of irregularities in the paper web and/or in the envelope surface of the counter roll. Thus, the flexible pressure-equalizing membrane 20 creates a self-adjusting nip 2, having no or only a minimum of fluid leakage. Thus, through the opening 27 in the pressure-equalizing membrane 20, the pressure fluid in the pressure chamber 10 stands in direct contact with the movable belt. The complementary addition which has been done in said WO-publication in comparison to said DE-publication is that the flexible membrane has been provided with "pinholes 25" within its free edge zone 21 in order to conduct hydraulic fluid from the pressure chamber 10 to the belt 6 for the purpose of lubricating the belt.

U.S. Pat. No. 5,980,693 describes presses having a tube-shaped or inflatable loading element, but with a metal shoe between the loading element and the inside of the belt. Furthermore, this part of the shoe is constructed in order to provide a slow reduction of the pressure in nip outlet. Normally, an abrupt pressure drop is desired.

U.S. Pat. No. 3,839,147 describes a shoe press having two opposed shoes. Each shoe has a metal bottom and sills, sealing against the inside of the belt. The side of the shoe facing the belt is a perforated diaphragm, which causes the pressure of the hydraulic fluid in a pressure chamber to load the inside of the belt directly. The shoe is of a rather complicated construction with various apertures and reinforcements.

U.S. Pat. No. 5,951,824 describes an ordinary shoe having ordinary hydraulic loading elements. The shoe is coated with a soft and durable layer of polymer or rubber in order to reduce the risk of damages to the belt and shoe from paper wads passing through the press nip.

EP 0 575 353 describes a press having a shoe, which is loaded with bellows being arranged inside a metal cover of the shoe, wherein a belt slides around said metal cover.

U.S. Pat. No. 6,334,933 describes a press having a counterpart of metal, which is provided with a plurality of pressure pockets being sealed by a metal plate and hoses, which also can contribute to loading the opposite portions of the press nip.

U.S. Pat. No. 6,387,216 describes a press having an open fluid chamber, over which a belt is running and which is loading the press nip. The chamber is sealed by means of setting the belt under pressure, so that it is tightened over the edges of the chamber.

EP 1 319 744 describes a method for measuring and regulating the nip pressure in a shoe press, crosswise to and along the web, by means of measuring and continuously adapting the hydraulic static pressure in reference points above measurement holes in the press nip.

DE 30 30 233 describes an elastic slide shoe which is attached to a stand of metal. The slide shoe includes a solid body or a hollow body in the form of a hose which can be filled with a pressure medium. The hose is surrounded by an elastic belt which is attached to the metal stand. The hollow body may be divided into chambers which can be pressurized to different pressures. However, a change of pressure in the chamber or chambers does not result in a change of the loading in the nip because of the fact that the hollow body is permitted to expand laterally during every such increase of pressure.

U.S. Pat. No. 4,576,682 describes a press with a shoe consisting of two shoe parts each of which being able to load the nip in a hydrodynamic manner.

U.S. Pat. No. 4,568,423 describes a press with a shoe having a shoe part in the form of a hydrostatic chamber, and two further shoe parts having hydrodynamic press function, said further shoe parts also sealing the hydrostatic shoe part.

It is an object of the invention to provide an elastic support body which, in relation to known support bodies, can be manufactured in a more simple way, without any special machining and without any major consideration to the shape of the opposed surface which it is to work against, and which can provide a loading profile in dependence of the pressure that can be applied with the loading system in the same way or even in a better way than what is possible with a conventional support body of metal with one or more rows of pressure pockets which are closed by a running belt.

The support body according to the invention is characterized in that the support body is elastically deformable and has its contact surface adaptable to the opposed surface in interaction therewith.

The holding device according to the invention is characterized in that the support body is elastically deformable and has its contact surface adaptable to the opposed surface in interaction therewith.

The apparatus/press according to the invention is characterized in that the support body/press body is elastically deformable and has its contact surface/press surface adaptable to the opposed surface in interaction therewith.

The method of forming an extended nip according to the invention is characterized by the steps of:

mounting the support body in said holding device;

loading the support body by means of the loading system; and displacing the contact surface of the support body in the direction towards the opposite surface under the influence of said loading in order to elastically deform the contact surface and adaptation to the opposite surface.

The method of controlling the load in an extended nip according to the invention is characterized by the steps of:

designing the support body of at least two layers of elastic material having different elasticity;

mounting the support body in said holding device;

loading the support body by means of the loading system; and displacing the contact surface of the support body in the direction towards the opposite surface under the influence of said loading in order to elastically deform the contact surface and adaptation to the opposite surface in order to obtain an extended nip having a load profile in dependence of different elasticities of the layers.

The expression "nip" is to be interpreted in its broadest meaning in order to involve such a nip that is defined by a wire and support body.

In the following, the invention will be described further with reference to the drawings.

The invention will be described in connection with a press for dewatering a fibre web. Naturally, in addition to the press section, the invention can be applied to any suitable apparatus for the treatment of a fibre web, e.g. an apparatus in a drying or forming section of a paper or board machine, and in a calender for surface treatment of the fibre web.

Figure 1:
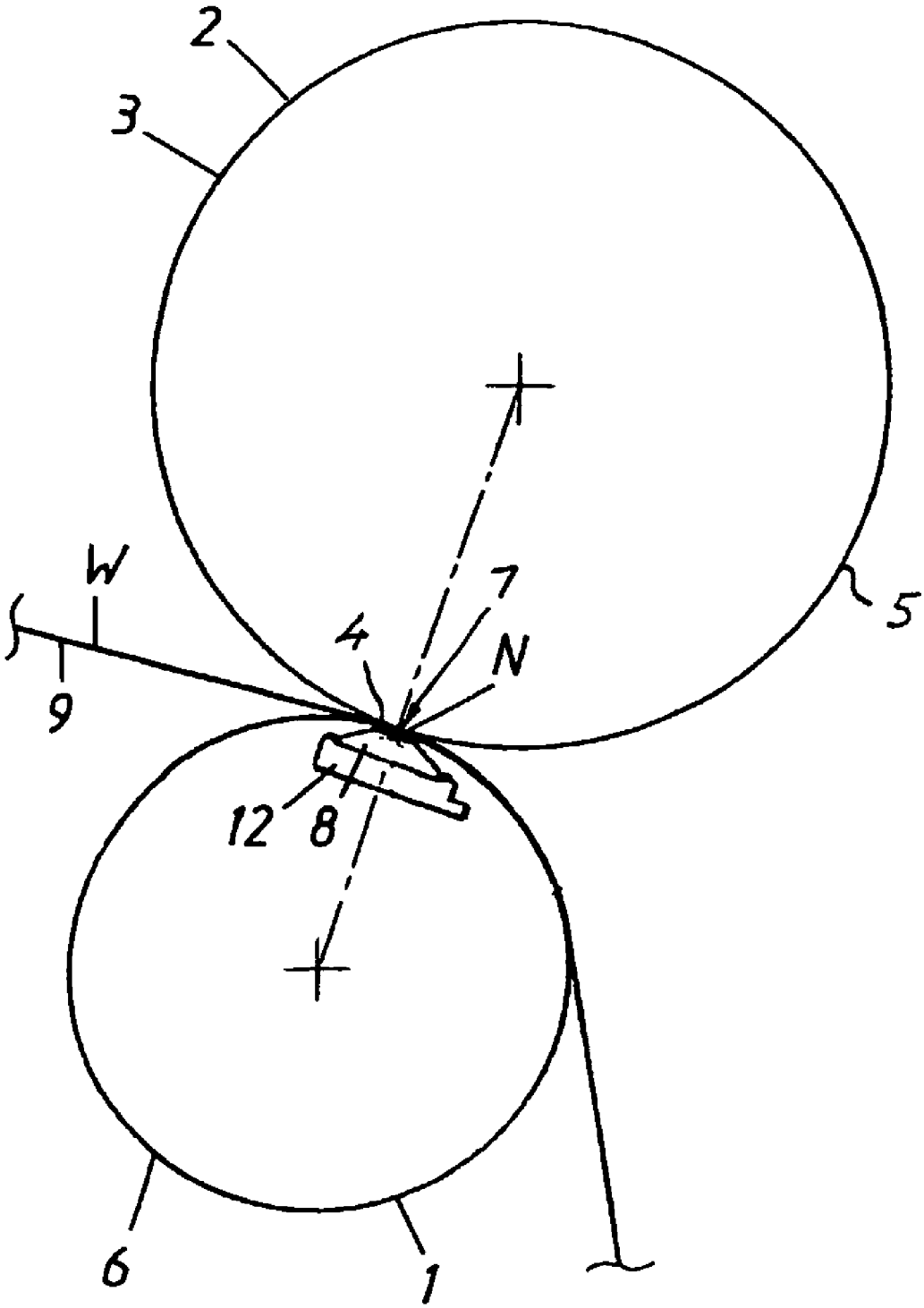
FIG. 1 shows a press according to the invention with a press body and a holding device according to a first embodiment.

FIG. 1 shows schematically portions of a press, which is arranged in the press section of a paper or board machine in order to press water out of a formed, wet fibre web. Advantageously, the invention can be used in a paper machine of the tissue machine type. The press includes a first press element 1 and a second press element 2. The press elements 1, 2 are interacting with each other in order to form an extended press nip N.

The second press element 2 includes a counter-pressure member being active in the press nip N and having a movable, endless surface 3, which forms an opposed surface or counter-pressure surface 4, which can be curved or linear, within the press nip N. In the shown embodiment of the press, the second press element 2 consists of a counter roll in the form of a press roll. The counter roll also can be a drying cylinder in a conventional drying section, or a drying cylinder in a tissue machine designated Yankee cylinder. In this case, the counter-pressure member includes the cylindrical wall 5 of the counter roll 2 the envelope surface of which forms said movable, endless surface 3, which within the extended press nip N forms said counter-pressure surface 4, which can be at room temperature or a temperature raised by means of heating. Provided that the cylinder wall 5 is thick and stable enough, it constitutes the counter-pressure member as such. In the case when the cylinder wall 5 is thin and deformable, the counter-pressure member further includes an internal supporting system (not shown), which provides the necessary counter-force.

The first press element 1 includes a movable, endless belt 6 of a flexible material, a support body 7 in the form of a press body, a holding device 8 for mounting the press body 7, a support for mounting the holding device 8, and a loading system for activating the press body 7. The movable belt 6 describes a closed loop inside of which the press body 7 and the support are located. Before the press nip N, the movable belt 6 is arranged for meeting a press felt 9 carrying a wet fibre web W which is to be dewatered when it passes through the extended press nip N. The loading system is arranged for being activated in order to influence the press body 7 during the operation of the press for obtaining pressure forces which the press body 7 exerts against the counter roll 2 via the belt 6, the press felt 9 and the web W. The press body 7 is arranged for deciding the length of the extended press nip N, as seen in the machine direction. The press body 7 has a free sliding surface 10 (see FIG. 3) with which the rotating belt 6 is in sliding contact during the operation of the press, whereby the sliding surface 10 entirely or partially forms a contact surface or press surface 13, which together with said counter-pressure surface 4 defines the press nip N. In addition to the sliding surface 10/press surface 13, the press body 7 having two vertical side surfaces 69, 70 (see FIG. 6) facing from each other, being parallel with each other and connecting to the sliding surface 10/press surface 13, and a bottom surface 71 facing from the sliding surface 10/press surface 13 and connecting to the side surfaces 69, 70 under right angle. A spraying device (not shown) is mounted upstream the press body 7 for supplying lubricant on the inside of the belt 6 in order to form a film which reduces the friction between the rotating belt 6 and the press body 7.

In the shown embodiment of the press, the first press element 1 consists of a press roll, the shell of which forms the movable belt 6 which thus describes a substantially circular loop. In an alternative embodiment of the press (not shown), the flexible, movable belt is arranged for running in a non-circular loop, e.g. in a substantially oval loop or in a substantially triangular loop, around the press body and one or several guide rolls. In the embodiment shown, the press roll 1 has two circular, rotatably mounted end walls (not shown), whereby the shell 6 is rigidly mounted to the peripheries of the end walls in order to rotate together with them. The shell 6 and the end walls define a closed space in which the support is located, said support including a stationary supporting beam 12 extending axially between the end walls without touching them. Also the press body 7 and its holding device 8 are extending axially between the end walls without touching them. Alternatively, the second press element 2 can be of the same or substantially the same design as the above-described first press element 1, whereby the press nip thus is formed by two press bodies according to the invention.

According to the invention the press body 7 is elastically deformable and has its press surface 13 adaptable to the counter-pressure surface 4 in interaction with this. This adaptation takes place under the influence of a load being created by said loading system, on the press body 7 in direction towards the counter-pressure surface 4 in order to load the entire press nip N correspondingly. The definition that the press body is elastically deformable does not necessarily imply that the entire press body consists of an elastic material, but should in the context of the invention be seen in a broader sense, viz. that the press body has at least one functional portion consisting of an elastic material and fulfilling said definition. For practical and production-engineering reasons, and according to the most preferred embodiments the press body is in its entirety made in one piece of an elastic material or several pieces of elastic material, where the pieces have different elasticity. The press body forms the entire length of the press nip seen in the machine direction.

Figure 2:
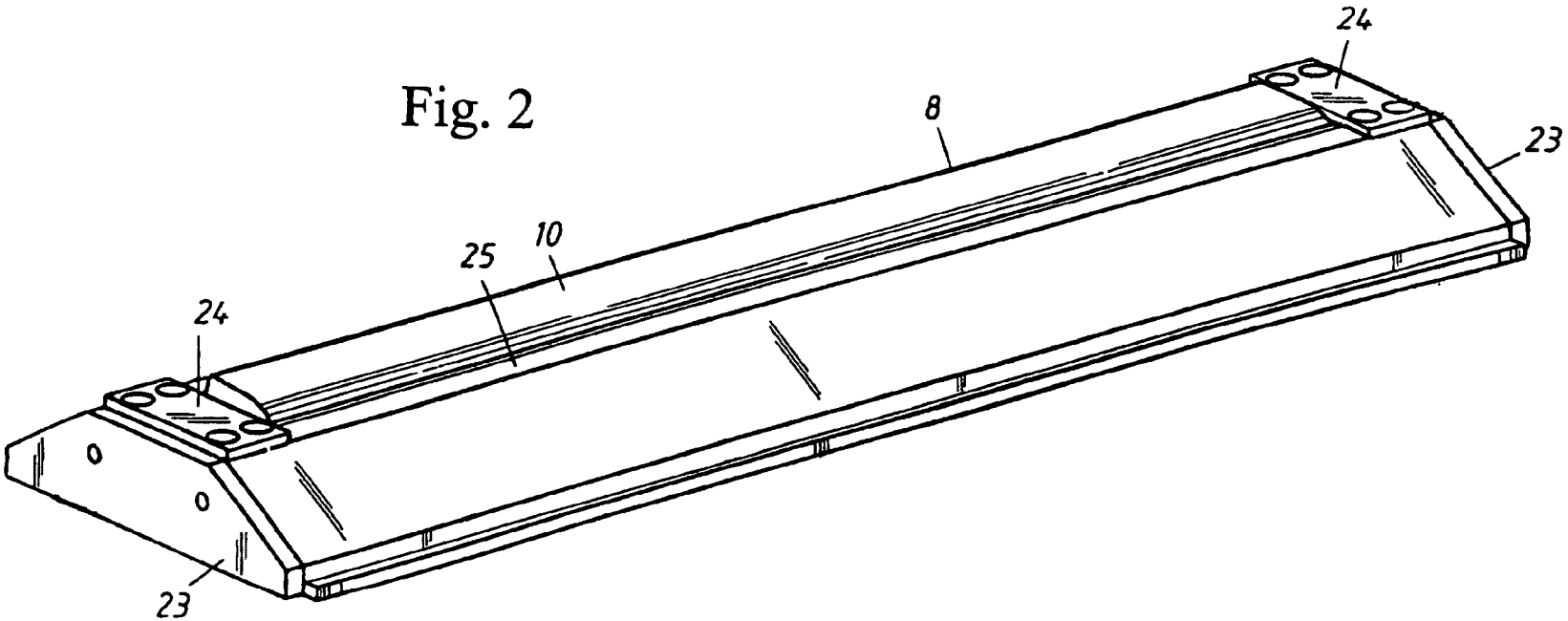
FIG. 2 is a perspective view of the press body and the holding device according to FIG. 1.
Figure 3:
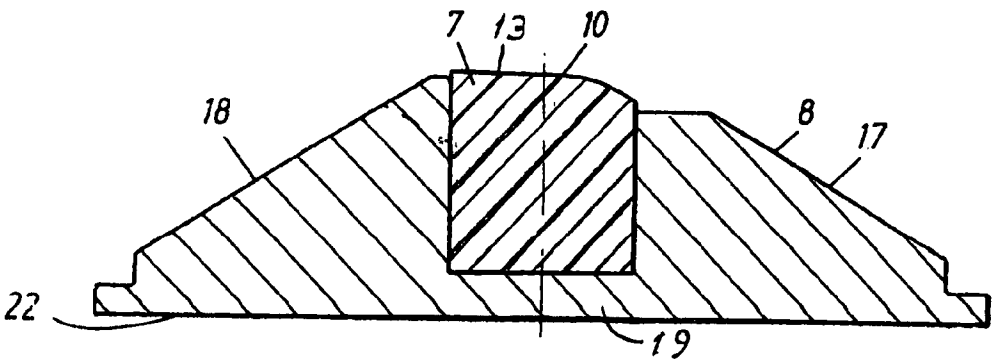
FIG. 3 is a cross-section of the press body and the holding device according to FIG. 2.
Figure 4:
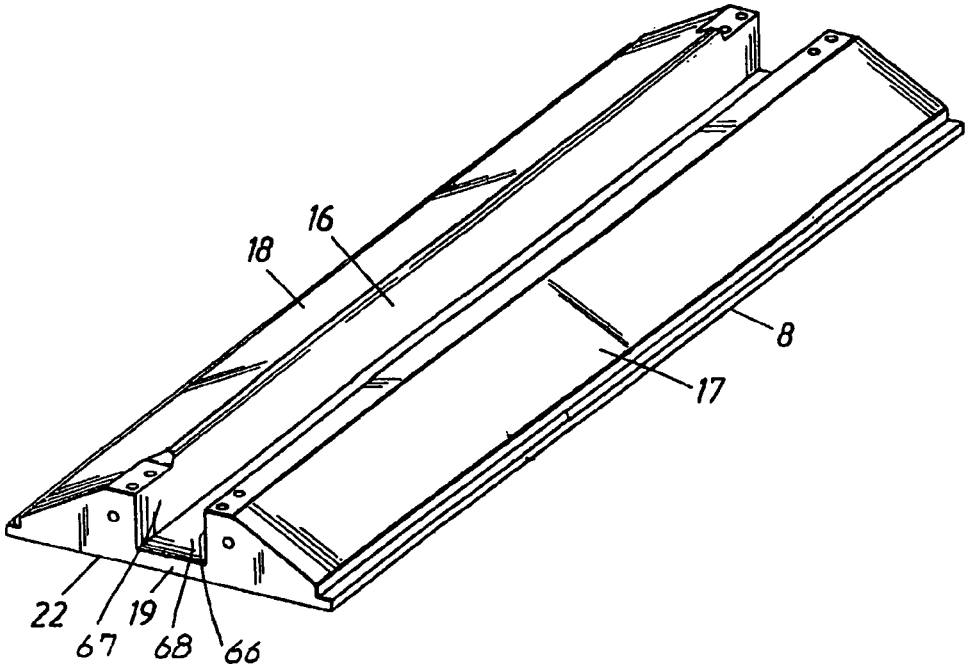
FIG. 4 is a perspective view of the holding device according to FIG. 2, without press body.
Figure 5:
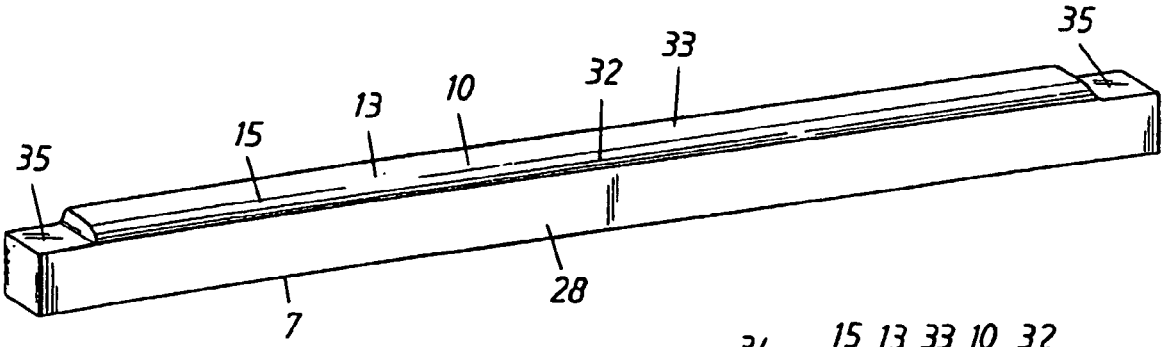
FIG. 5 is a perspective view of the press body itself according to FIG. 2.
Figure 6:
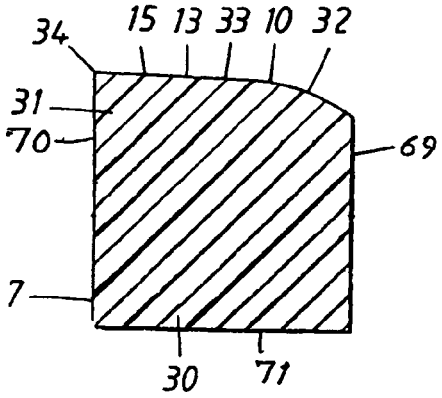
FIG. 6 is a cross-section of the press body according to FIG. 5.

The press body 7 and its holding device 8, that is a part of the press according to FIG. 1, are shown in detail in FIGS. 2 and 3, whereas these two structural elements are shown separately in detail in FIGS. 5 and 6 and FIG. 4, respectively. As is evident from FIG. 4, the holding device 8 includes an elongated, beam-formed holder 22, which is form-stable and provided with an axially through-going channel 16 having a U-shaped or rectangular cross-section and being defined by two side support portions 17, 18 and a bottom support portion 19 connecting them, said three portions 17, 18, 19 form two inner side surfaces 66, 67 (see FIG. 6) facing each other and being parallel with each other, and an inner bottom surface 68 forming a right angle to the side surfaces 66, 67. The three surfaces 66, 67, 68 thus define said channel 16. Furthermore, it is evident from FIG. 2 that the holding device includes two end plates 23 for detachable mounting to the opposed, parallel end surfaces of the holder 22 as well as two clamping plates 24 for detachable mounting on top of the side support portions 17, 18. As is evident from FIGS. 2 and 3, the side support portion 17, being intended to be located at the inlet of the press nip N, is provided with a recess 25 extending between the clamping plates 24 in order to expose the press body 7. FIGS. 5 and 6 show the press body 7, which is intended to be mounted in the channel 16 of the holder 22 and which has a cross-section being adapted to the cross-section of the channel 16, so that no play arises between opposite lateral surfaces 67, 69; 68, 70 and so that the press body 7 with its bottom surface 71 comes to rest against the bottom surface 68 of the channel 16. The press body 7 has a top portion 31 that includes said sliding surface 10 and being arranged to be located outside the holding device 8, as is shown in the drawings, at least when the press body entirely fills up the channel 16. In order to avoid undesired deformation laterally the top portion 31 has a limited dimension outside the holding device, however this dimension is sufficient to prevent the holding device 8 coming in contact with the belt 6 when the press nip is loaded. The said free sliding surface 10, which will be facing the counter roll 2, and with which the rotating belt 6 will be in sliding contact during operation, is, as seen in a cross-sectional view, designed with a predetermined arch-shape in order to form an initial, curved surface portion 32 having a predetermined radius, and a surface portion 33 being tangential to the curved surface portion 32 and extending up to the sharp corner 34 which the sliding surface 10 forms with the side surface 70 being fixed in the machine direction. The purpose of the curved surface portion 32 is to create a wedge between the rotating belt 6 and the curved surface portion 32 in order to make it possible to get lubricant to follow the belt 6 on its inside while forming a film between the belt 6 and the sliding surface 10. Said corner 34 forms the outlet of the press nip N, while the inlet of the press nip N at the curved surface portion 32 becomes floating depending on the pressure provided by the loading system. The press body 7 has recessed end portions 35 which enable a simple, detachable mounting in the holder 22 by means of said clamping plates 24, as is evident from FIG. 2.

As mentioned in the foregoing, the press body 7 is elastically deformable in order to bring the press surface 13 to form in compliance with the counter-pressure surface 4 of the counter roll. As is evident from FIG. 6, the press body 7 is made in one piece of an elastic material. The elastic deformation occurs both in the machine direction MD and crosswise to the machine direction CD in dependence of the shape of the counter-pressure surface 4, i.e. the press surface 13 conforms to and adopts the outline of the counter-pressure surface 4, and the portion of the sliding surface 10 defining the press nip, i.e. the press surface 13, which in this case corresponds to said press zone 15, changes its form in accordance with the opposed counter-pressure surface 4 of the counter roll 2.

Figure 7:
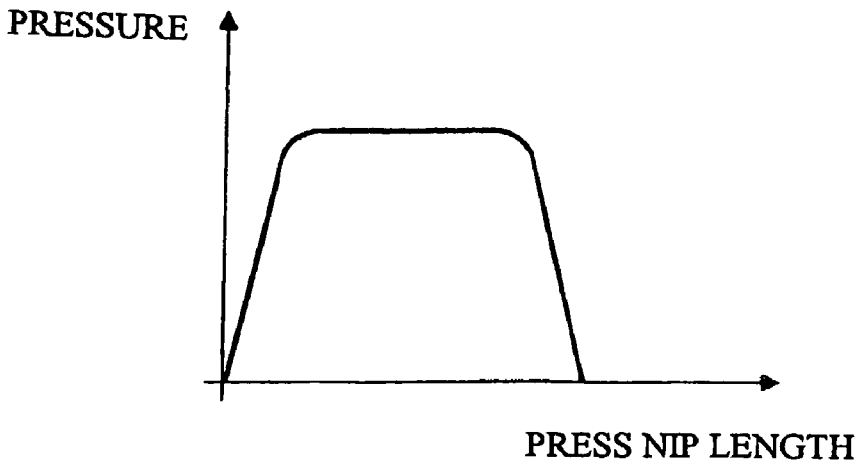
FIG. 7 is a graph depicting the pressure curve which is obtained with the press body according to the first embodiment.

The press body 7, being used in the embodiments according to FIGS. 1-6, and being designed in one piece, achieves a load profile or pressure curve as illustrated in FIG. 7.

FIGS. 8-14 illustrates schematically different embodiments of the combination of press body 7, holding device 8 and loading system.

Figure 8:
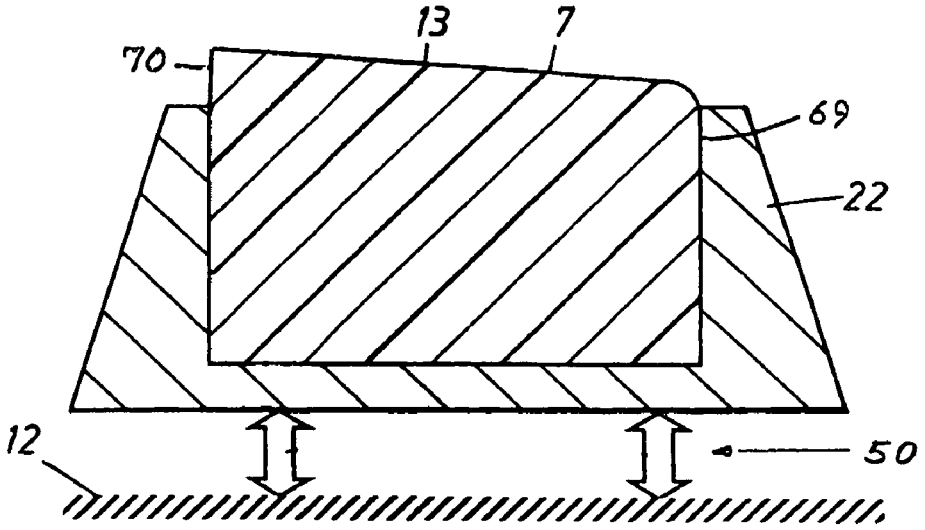
FIGS. 8-10 show schematically a press body and a holding device according to the invention and different types of loading systems.

In the embodiment according to FIG. 8 the loading system comprises a power transmitting device 50 in the form of hydraulic cylinders, pneumatic cylinders, jacks or similar which are mounted in two rows between the holder 22 and the supporting beam 12. The press surface 13 is inclined in relation to the side surfaces 69, 70. By the influence of the power transmitting device 50 the press body 7 is pressed against the counter-pressure surface 4 which is deformed elastically to conform to and adopt the contour of the counter-pressure surface 4.

Figure 9:
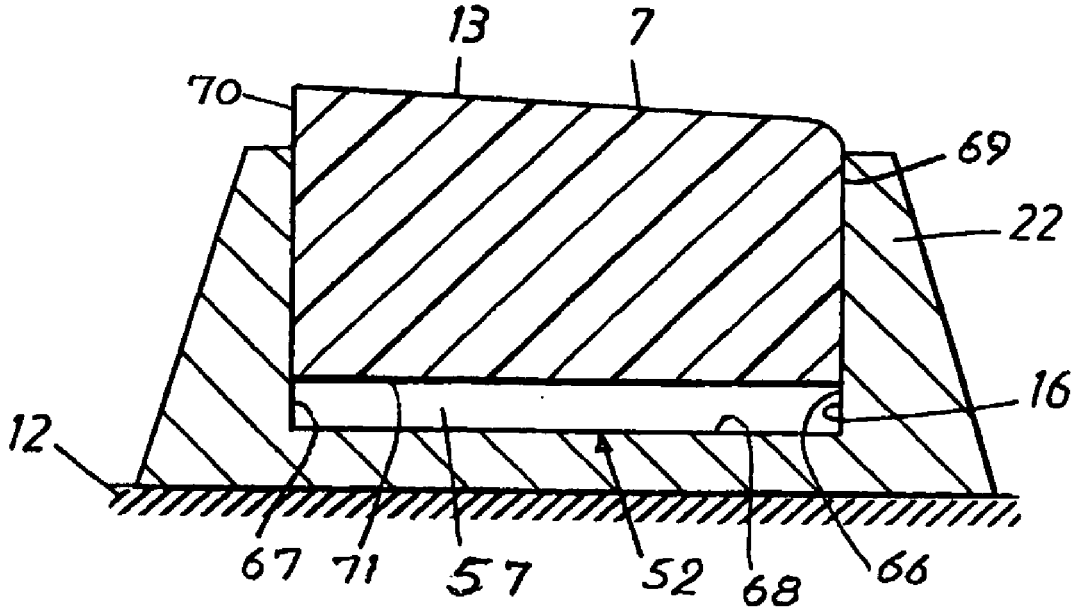
Figure 11:
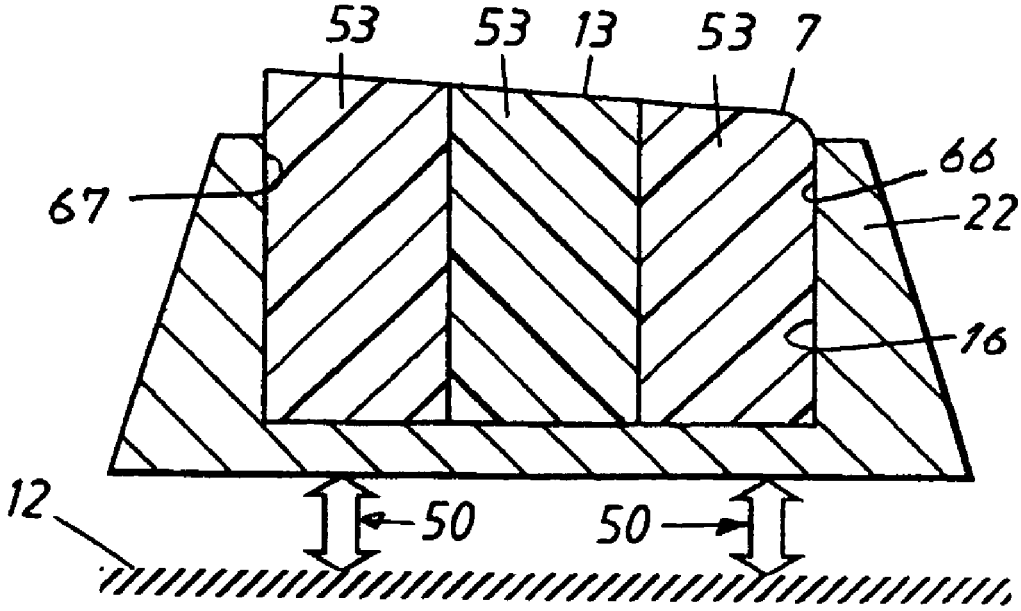
FIG. 11 shows schematically a press body consisting of three vertical layers of elastic material with different elasticity.

In the embodiment according to FIG. 9 the loading system comprises a power transmitting device 50 which includes a pressure chamber 57 being in communication with a pressure medium source (hydraulic or pneumatic) through a conduit and a suitable control member (not shown) for regulating the pressure in the pressure chamber 57. In this case the holder is rigidly mounted to the supporting beam 12. The pressure chamber 57 is defined by an inner portion of the channel 16 in which the press body 7 is received in a sealing manner. The press body 7 thus functions as a piston to be slidably moved in relation to the counter roll 2 and elastically deformed against this in dependence of the pressure prevailing in the pressure chamber 57. Since the press body 7 consists of elastic material it will itself form a seal against the side walls 66, 67 of the holder 22. Alternatively, if desired, special sealings (not shown) can be mounted in said side walls 66, 67 in order to seal against the opposite side surfaces 69, 70 of the press body 7.

Figure 10:
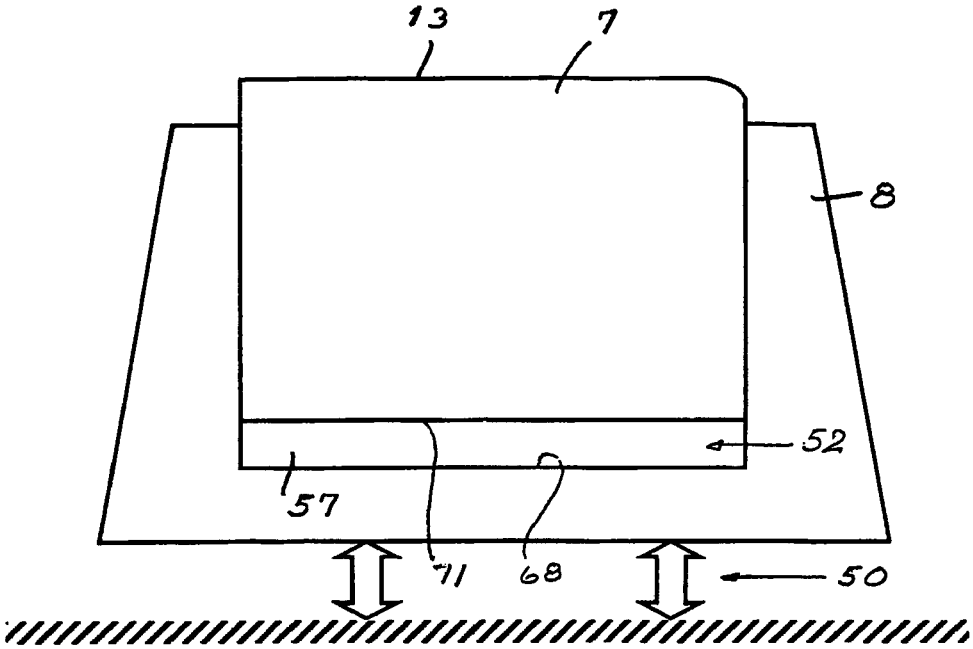

In the embodiment according to FIG. 10 the loading system comprises a combination of the embodiments according to FIGS. 8 and 9, i.e. a first power transmitting device 50 of the type defined and a second power transmitting device 52 of the type defined. In such an arrangement the press body 7 can be mounted in a first starting position having its press surface 13 at a touch-free distance from the opposite counter-pressure surface 4, wherein the holding device 8 and the press body 7 are arranged to be moved together by means of the first power transmitting device 50 in the direction towards the counter-pressure surface 4 to a second starting position having the press surface 13 of the press body 7 in contact with or nearly in contact with the counter-pressure surface 4 (via the belt 6). The pressure in the pressure chamber 57 is then raised so that the press body 7 slides out from the holding device a small distance and is pressed against the counter-pressure surface 4 while becoming elastically deformed in order to form a nip-forming operation position with a desired load profile, wherein the first power transmitting device 50 now at first hand functions as a counterstay.

Figure 12:
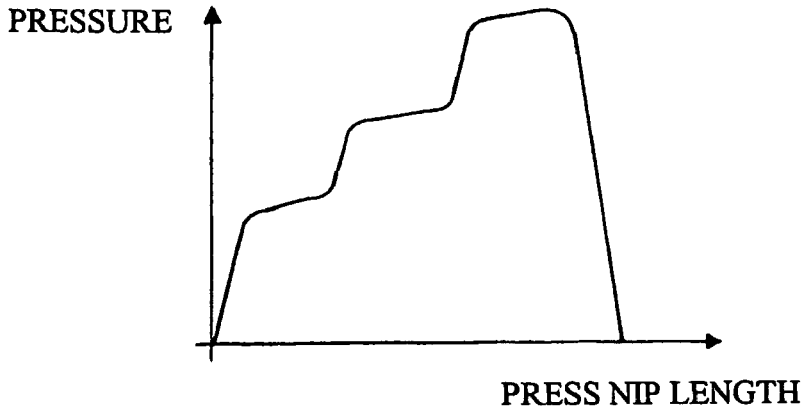
FIG. 12 is a graph depicting the pressure curve which can be obtained with the press body according to FIG. 11.

In the embodiments described above the press body 7 is made in one piece of elastic material. In the embodiment according to FIG. 11 the press body 7 is made of three longitudinal, vertical pieces 53 of elastic material with different coefficients of elasticity, said pieces 53 forming layers and being parallel with the vertical side surfaces 66, 67 of the channel 16. Such a multi-layered press body 7 produces a stepped load profile or press curve as illustrated in FIG. 12.

Figure 13:
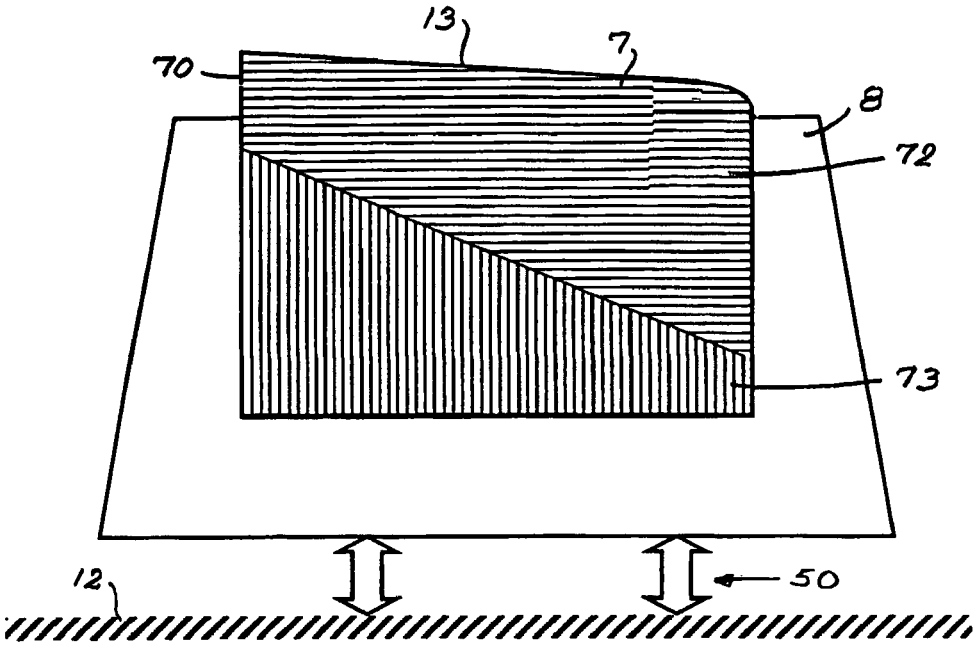
FIGS. 13 and 14 show schematically press bodies consisting of two and three, respectively, inclined layers of elastic material with different elasticity.
Figure 14:
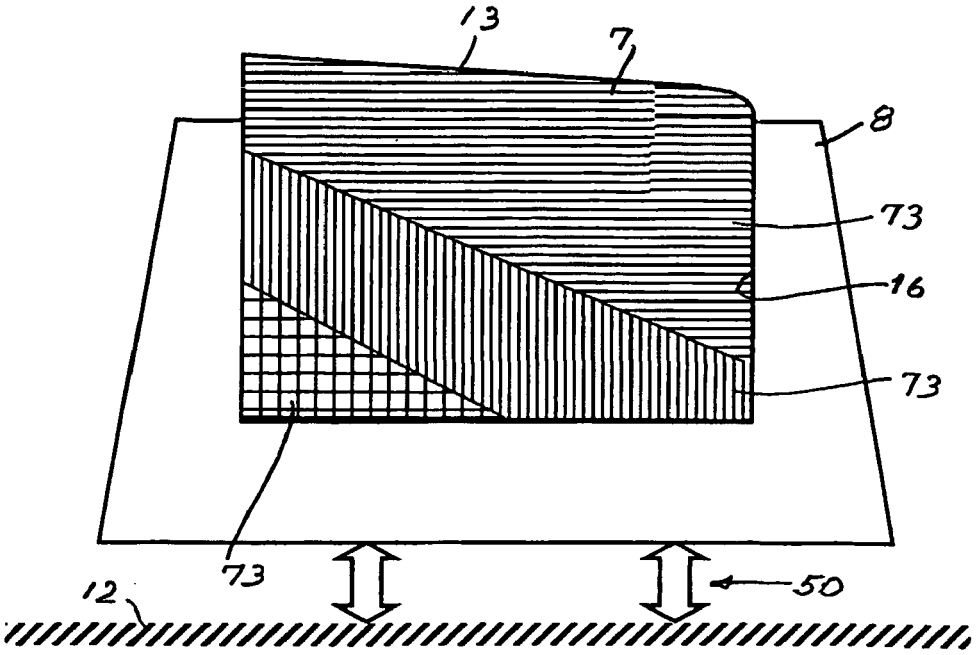

In FIGS. 13 and 14 further examples of multi-layered press bodies 7 are illustrated, wherein the surfaces of the layers 72 and 73, respectively, contacting each other are inclined, i.e. the surfaces define an acute angle with the downstream, vertical side surface 70 of the press body 7. The layers have different elasticities or hardness values, as is indicated by the line and square designed surfaces, for attaining load profiles with different progresses in dependence of the compression or deformation of the different layers.

With the exception for the embodiment according to FIG. 10, the press bodies 7 are designed with a press surface 13 that is inclined so that it defines an acute angle just under 45°, i.e. between 42° and 44.9°, with the downstream side surface 71 of the press body 7 thereby initiating the load at the outlet portion of the nip when the press body is moved towards the counter-pressure surface 4. In the embodiment according to FIG. 10 on the other hand, the press surface 13 is plane so that it defines a right angle to the upstream side surface 70 of the press body 7.

In an alternative embodiment (not shown) of the press body, at least one of said elastic layers is made of at least three sections, that are distributed crosswise to the machine direction, of elastic material of at least two different elasticities in order to obtain load profiles describing different curves depending on the composition of the sections in each cross-section of the press body.

In the above-described embodiments, the press body is homogeneous, i.e. it lacks enclosed cavities. However, if desired, the press body can be made with one or several enclosed cavities or enclosed cells so that each such cavity or cell is without any communication with the surroundings. One or several such enclosed cavities or enclosed cells will increase the ductility of the press body in connection with its sliding surface and in relation to the counter roll.

The press body according to the invention has a number of essential advantages of which the following can be mentioned.

- It is self-conforming to the outline of the counter-pressure surface.
- It conforms to and follows the deformation of the counter-pressure surface.
- It avoids abnormal wear of the edges of the press felt.
- It is forgiving to e.g. a paper wad passing through the press nip.
- It can be manufactured at a very low cost.
- It can be designed for controlling the load within the entire press nip, or within successive sections of the press nip and independently of each other.

The support bodies which are described above and shown in the drawings have been designated press bodies, since they are used in a press apparatus. Naturally, the same embodiments of the press body can be used in other apparatus for the treatment of a fibre web in a paper or board machine, or in a calender. When the invention is applied to e.g. a wire section, the belt 6 of the first press element 1 in FIG. 1 can be replaced with a clothing, such as e.g. a wire.

The load in the nip can vary from 0 to 3000 kN/m.

The support body may have a dimension in the machine direction which typically is 50-500 mm.

The desirable elastic properties of the support body are achieved by means of a material, having a coefficient of elasticity which is substantially lower than that of metal, such as steel and aluminium, so that the support body can be elastically compressed. Typical hardness values of the elastic material is 50-95 Shore A. The elastic material should also give the support body a sufficient strength/hardness in order to withstand wear, but at the same time make the support body elastically deformable enough in order to obtain the desired function according to the invention. As elastic materials, plastic and rubber materials can be used, such as polymers, composite materials, which can be reinforced with e.g. glass fibres, carbon fibres or textile. At present, polyurethane is a preferred polymer. If desired, the contact surface of the support body can be covered by an exchangeable, thin wear protection (not shown), the one side edge portion of which being rigidly mounted to the upstream side of the holder, while the other side edge portion is free to follow the movement and deformation of the support body.

The invention claimed is:

1. A support body for an apparatus having an extended nip being defined by a contact surface of the support body and an opposed surface, said support body has two side surfaces facing from each other and connecting to said contact surface, and a bottom surface facing from the contact surface, is arranged to be moved in the direction towards the opposed surface by means of a loading system in order to load the extended nip via said contact surface, and is elastically deformable and has its contact surface adaptable to the opposed surface in interaction therewith, wherein the support body is made of at least two layers of elastic material, said layers being joined to form a unit, wherein each of said layers forms a contact zone of the contact surface and the layers have different elasticities.

2. The support body according to claim 1, wherein the support body is made of a plastic material or rubber material including polymer with or without reinforcing fiber or textile material.

3. The support body according to claim 2, wherein the polymer is polyurethane.

4. The support body according to claim 1, wherein the support body is adapted to operate at a load in the extended nip which varies from 0 to 3000 kN/m.

5. The support body according to claim 1, wherein the support body has a dimension in the machine direction of 50-500 mm.

6. A support device for an apparatus having an extended nip, comprising:

a support body, said support body has two side surfaces facing from each other and connecting to said contact surface, and a bottom surface facing from the contact surface, is arranged to be moved in the direction towards the opposed surface by means of a loading system in order to load the extended nip via said contact surface, and is elastically deformable and has its contact surface adaptable to the opposed surface in interaction therewith; and a holding device for the support body arranged to form a counterstay for said two side surfaces of the support body and directly or indirectly form a counterstay for said bottom surface of the support body, and wherein the support body has a top portion which has said contact surface and is arranged to protrude from the holding device at least in a nip-forming operation position of the support body.

7. The support device according to claim 6, wherein the holding device has a space for receiving the support body, said space having two side surfaces for interaction with the opposite side surfaces of the support body, and a bottom surface facing to the bottom surface of the support body.

8. The support device according to claim 7, wherein said top portion is arranged to protrude from the holding device, said bottom surfaces of the support body and holding device are in direct contact with each other, and the loading system comprises a power transmitting device arranged to move the holding device together with the support body in order to load the extended nip.

9. The support device according to claim 8, wherein the power transmitting device is selected from the group consisting of hydraulic cylinders, pneumatic cylinders, and jacks.

10. The support device according to claim 7, wherein the bottom surface of the support body is located at a distance from the bottom surface of the holding device to define an enclosed chamber therebetween, and the loading system comprises a power transmitting device including a pressure chamber formed by said enclosed chamber and arranged to be pressurized in order to move the support body in relation to the holding device in order to load the extended nip while the support body is elastically deformed.

11. The support device according to claim 7, wherein the bottom surface of the support body is located at a distance from the bottom surface of the holding device to define an enclosed chamber therebetween, the loading system comprises a first power transmitting device arranged to move the holding device together with the support body from a first starting position with the contact surface of the support body at a distance from the opposed surface to a second starting position with the contact surface of the support body located adjacent or close to the opposed surface, and a second power transmitting device comprising a pressure chamber formed by said enclosed chamber and being arranged to be pressurized with an increased pressure in order to move the support body in relation to the holding device to load the extended nip while the support body being elastically deformed to form a nip-forming operation position.

12. The support device according to claim 6, wherein the contact surface of the support body is covered by an exchangeable, thin wear protection layer having one side edge portion rigidly affixed to an upstream side of the holding device and an opposite side edge portion that is free to follow movement and deformation of the support body.

13. An apparatus for the treatment of a fiber web that is manufactured in a paper or board machine, comprising a first structural element and a second structural element which is movably arranged and has an opposed surface for interaction with the first structural element while forming an extended nip, said first structural element comprising a movable clothing and a support device comprising a support body having a contact surface which defines said extended nip together with the opposed surface, wherein said support body has two side surfaces facing from each other and connecting to said contact surface, and a bottom surface facing from the contact surface, is arranged to be moved in the direction towards the opposed surface by means of a loading system in order to load the extended nip via said contact surface, and is elastically deformable and has its contact surface adaptable to the opposed surface in interaction therewith, wherein the support body is made of at least two layers of elastic material, said layers being joined to form a unit;

wherein the support device further comprises a holding device for the support body arranged to form a counterstay for said two side surfaces of the support body and directly or indirectly form a counterstay for said bottom surface of the support body, and wherein the support body has a top portion which has said contact surface and being arranged to protrude from the holding device at least in the nip-forming operation position of the support body.

14. The apparatus according to claim 13, wherein each of said layers of the support body forms a contact zone of the contact surface and the layers have different elasticities.

15. The apparatus according to claim 13, wherein the support body is made of rubber or polymer.

16. The apparatus according to claim 13, wherein the support body is adapted to operate at a load in the extended nip which varies from 0 to 3000 kN/m.

17. The apparatus according to claim 13, wherein the support body has a dimension in the machine direction of 50-500 mm.

18. The apparatus according to claim 13, wherein the second structural element also comprises a said support body defining a contact surface forming said opposed surface.

19. A press for the treatment of a fiber web that is manufactured in a paper or board machine, comprising a first press element and a second press element which is movably arranged and having an opposed surface for interaction with the first press element while forming an extended press extended nip, said first press element comprising a movable belt and a press device which comprises a press body having a press surface which defines said extended nip together with the opposed surface, said press body has two side surfaces facing from each other and connecting to said press surface, and a bottom surface facing from the press surface, is arranged to be moved in the direction towards the opposed surface by means of a loading system in order to load the extended nip via said press surface, and is elastically deformable and has its press surface adaptable to the opposed surface in interaction therewith, wherein the press body is made of at least two layers of elastic material, said layers being joined to form a unit, wherein each of said layers of the press body forms a contact zone of the press surface and the layers have different elasticities.

20. The press according to claim 19, wherein the press device also comprises a holding device for the press body arranged to form a counterstay for said two side surfaces of the press body and directly or indirectly form a counterstay for said bottom surface of the press body, and the press body has a top portion which has said press surface and being arranged to protrude from the holding device at least in the nip-forming operation position of the press body.

21. The press according to claim 19, wherein at least one of the opposed surface and the press surface is heated.

22. The press according to claim 19, wherein the second press element also comprises a said press body defining a press surface forming said opposed surface.

* * * * *